US010825668B2

(12) United States Patent
Burton et al.

(10) Patent No.: US 10,825,668 B2
(45) Date of Patent: Nov. 3, 2020

(54) LIBRARY SEARCH TOLERANT TO ISOTOPES

(71) Applicant: DH Technologies Development Pte. Ltd., Singapore (SG)

(72) Inventors: Lyle Lorrence Burton, Woodbridge (CA); David Michael Cox, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 380 days.

(21) Appl. No.: 15/750,557

(22) PCT Filed: Aug. 9, 2016

(86) PCT No.: PCT/IB2016/054777
§ 371 (c)(1),
(2) Date: Feb. 6, 2018

(87) PCT Pub. No.: WO2017/025893
PCT Pub. Date: Feb. 16, 2017

(65) Prior Publication Data

US 2020/0090918 A1 Mar. 19, 2020

Related U.S. Application Data

(60) Provisional application No. 62/204,511, filed on Aug. 13, 2015.

(51) Int. Cl.
*H01J 49/00* (2006.01)

(52) U.S. Cl.
CPC ..... *H01J 49/0036* (2013.01); *H01J 49/0081* (2013.01)

(58) Field of Classification Search
CPC ..... H01J 49/004; H01J 49/0036
See application file for complete search history.

(56) References Cited

U.S. PATENT DOCUMENTS 6,147,344 A * 11/2000 Annis ..... H01J 49/0036 250/281
8,263,931 B2 * 9/2012 Boecker ..... G01N 33/6848 250/282

(Continued)

OTHER PUBLICATIONS

Tsugawa, Hiroshi, et al. "Hydrogen rearrangement rules: computational MS/MS fragmentation and structure elucidation using MS-FINDER software." Analytical chemistry 88.16 (2016): 7946-7958. (Year: 2016).*

(Continued)

*Primary Examiner* — Wyatt A Stoffa
(74) *Attorney, Agent, or Firm* — John R. Kasha; Kelly L. Kasha; Kasha Law LLC

(57) ABSTRACT

One or more known compounds of a sample are ionized using an ion source, producing an ion beam of precursor ions. A tandem mass spectrometer receives the ion beam from the ion source, selects one or more precursor ions from the ion beam using a precursor ion mass selection window, fragments precursor ions within the precursor ion mass selection window, and mass analyzes the resulting product ions, producing an unknown product ion mass spectrum. A library product ion mass spectrum for a known compound is retrieved from a memory. Each peak of the unknown spectrum is analyzed for a potential non-halogen isotopic peak using a processor, and if a potential non-halogen isotopic peak is found, it is removed if it does not have a corresponding peak in the library spectrum.

13 Claims, 10 Drawing Sheets

(56) References Cited

U.S. PATENT DOCUMENTS

| | | | | |
|---|---|---|---|---|
| 8,666,681 | B2 * | 3/2014 | Noda | H01J 49/0036 702/30 |
| 10,163,619 | B2 * | 12/2018 | Brown | H01J 49/004 |
| 2003/0213902 | A1 * | 11/2003 | Takahashi | H01J 49/0027 250/282 |
| 2006/0195271 | A1 * | 8/2006 | Park | H01J 49/0036 702/27 |
| 2014/0379279 | A1 | 12/2014 | Pfaff | |
| 2015/0144778 | A1 * | 5/2015 | Bonner | H01J 49/42 250/282 |
| 2015/0170892 | A1 | 6/2015 | Geromanos et al. | |
| 2015/0219606 | A1 | 8/2015 | Morimoto | |
| 2017/0092476 | A1 * | 3/2017 | Duchoslav | H01J 49/0036 |

OTHER PUBLICATIONS

International Search Report and Written Opinion for PCT/IB2016/054777 dated Apr. 25, 2017.

* cited by examiner

600

LIBRARY SEARCH TOLERANT TO ISOTOPES

CROSS REFERENCE TO RELATED APPLICATION

This application claims the benefit of U.S. Provisional Patent Application Ser. No. 62/204,511, filed Aug. 13, 2015, the content of which is incorporated by reference herein in its entirety.

INTRODUCTION

Various embodiments relate generally to tandem mass spectrometry. More particularly various embodiments relate to systems and methods for comparing an experimental product ion spectrum to a known library product ion spectrum when the experimental product ion spectrum may contain isotopic peaks and the known library product ion spectrum may not.

In many mass spectrometry applications, library searching is used to identify an unknown compound or to confirm the presence of a suspected compound. This is done by comparing the mass spectrometry/mass spectrometry (MS/MS) mass spectrum, or product ion mass spectrum, of a pure standard (the "library" spectrum) with an experimental product ion mass spectrum (the "unknown" spectrum).

A number of different algorithms have been published that produce a similarity score between the two spectra. In these algorithms, peaks in the two spectra that have common m/z values generally improve the similarity score, and peaks in the two spectra that do not have common m/z values reduce the similarity score. In other words, product ion peaks shared by the two spectra improve the similarity score, and product ion peaks not shared by the two spectra reduce the similarity score.

Existing product ion spectral libraries typically contain data acquired at unit resolution precursor ion isolation, so isotopic peaks are not present in library product ion spectra. If the unknown product ion mass spectrum is also acquired at unit resolution precursor ion isolation, there is no problem comparing the two spectra and scoring the similarity of intensity peaks. If, however, the experimental mass spectrum is acquired with a precursor ion mass isolation window wide enough to include isotopic peaks, the two product ion spectra are more difficult to compare and the similarity score can be reduced by the isotopic peaks.

Unit resolution precursor ion isolation means that a precursor ion is selected or mass filtered with a precursor ion mass isolation window width of about 1 mass-to-charge ratio (m/z). An isotopic peak, as used herein, is a peak that represents an isotope of a known compound of interest. An isotope is a compound that differs from a known compound of interest only in the number of neutrons present.

Since a neutron has a weight of approximately 1 amu, an isotope of a known compound of interest differs in weight by 1 or more amu from the known compound of interest. Therefore, a peak that represents an isotope of a known compound of interest differs by 1 or more m/z from a peak that represents the known compound of interest.

For singly charges species, isotopic peaks are not found using unit resolution precursor ion isolation, because the 1 m/z precursor mass isolation window is centered at the m/z of the known compound of interest. This means that the precursor mass isolation window only extends ½ m/z beyond the known compound of interest.

Library spectra generally do not include isotope peaks because they were acquired using a tandem mass spectrometry method in which a narrow precursor mass isolation window was used—and most fragments of interest are singly charged. In general, tandem mass spectrometry involves ionization of one or more compounds from a sample, selection of one or more precursor ions of the one or more compounds using a precursor mass isolation window, fragmentation of the one or more precursor ions into product ions, and mass analysis of the product ions. Three broad categories of tandem mass spectrometry methods include 1) targeted acquisition, 2) information dependent acquisition (IDA) or data dependent acquisition (DDA), and 3) data independent acquisition (DIA).

Generally, targeted acquisition, information dependent acquisition (IDA), and even some data independent acquisition (DIA) tandem mass spectrometry methods use a narrow precursor mass isolation window. However, DIA methods, such as SWATH™ acquisition, use precursor mass isolation window wide enough to include isotopic peaks.

In a targeted acquisition method, one or more transitions of a precursor ion to a product ion are predefined for one or more compounds. As a sample is being introduced into the tandem mass spectrometer, the one or more transitions are interrogated during each time period or cycle of a plurality of time periods or cycles. In other words, the mass spectrometer selects a precursor ion using a narrow precursor mass isolation window, fragments the precursor ion of each transition, and performs a targeted mass analysis for the product ion of the transition. As a result, a product ion mass spectrum is produced for each transition. Targeted acquisition methods include, but are not limited to, multiple reaction monitoring (MRM) and selected reaction monitoring (SRM).

IDA is a tandem mass spectrometry method in which a user can specify criteria for performing targeted or untargeted mass analysis of product ions while a sample is being introduced into the tandem mass spectrometer. For example, in an IDA method, a precursor ion or mass spectrometry (MS) survey scan is performed to generate a precursor ion peak list. The user can select criteria to filter the peak list for a subset of the precursor ions on the peak list. MS/MS is then performed on each precursor ion of the subset of precursor ions, generally using a narrow precursor mass isolation window. A product ion spectrum is produced for each precursor ion. MS/MS is repeatedly performed on the precursor ions of the subset of precursor ions as the sample is being introduced into the tandem mass spectrometer.

In proteomics and many other sample types, however, the complexity and dynamic range of compounds is very large. This poses challenges for traditional targeted and IDA methods, requiring very high speed MS/MS acquisition to deeply interrogate the sample in order to both identify and quantify a broad range of analytes.

As a result, DIA methods have been used to increase the reproducibility and comprehensiveness of data collection from complex samples. DIA methods can also be called non-specific fragmentation methods. In a traditional DIA method, the actions of the tandem mass spectrometer are not varied among MS/MS scans based on data acquired in a previous precursor or product ion scan. Instead, a precursor ion mass range is selected. A precursor ion mass selection window is then stepped across the precursor ion mass range. All precursor ions in the precursor ion mass selection window are fragmented and all of the product ions of all of the precursor ions in the precursor ion mass selection window are mass analyzed.

The precursor ion mass selection window used to scan the mass range can be very narrow, so that the likelihood of multiple precursors and isotopes within the window is small. This type of DIA method is called, for example, MS/MS$^{ALL}$. In an MS/MS$^{ALL}$ method a precursor ion mass selection window of about 1 m/z is scanned or stepped across an entire mass range. A product ion spectrum is produced for each 1 m/z precursor mass window. A product ion spectrum for the entire precursor ion mass range is produced by combining the product ion spectra for each mass selection window. The time it takes to analyze or scan the entire mass range once is referred to as one scan cycle. Scanning a narrow precursor ion mass selection window across a wide precursor ion mass range during each cycle, however, is not practical for some instruments and experiments.

As a result, a larger precursor ion mass selection window, or selection window with a greater width, is stepped across the entire precursor mass range. This type of DIA method is called, for example, SWATH™ acquisition. In SWATH™ acquisition, the precursor ion mass selection window stepped across the precursor mass range in each cycle may have a width of 2-25 m/z, or even larger. Like the MS/MS$^{ALL}$ method, all the precursor ions in each precursor ion mass selection window are fragmented, and all of the product ions of all of the precursor ions in each mass isolation window are mass analyzed. However, because a wider precursor ion mass selection window is used, the cycle time can be significantly reduced in comparison to the cycle time of the MS/MS$^{ALL}$ method.

U.S. Pat. No. 8,809,770 describes how SWATH™ acquisition can be used to provide quantitative and qualitative information about the precursor ions of compounds of interest. In particular, the product ions found from fragmenting a precursor ion mass selection window are compared to a database of known product ions of compounds of interest. In addition, ion traces or extracted ion chromatograms (XICs) of the product ions found from fragmenting a precursor ion mass selection window are analyzed to provide quantitative and qualitative information.

As a result, a DIA method that uses a precursor ion mass selection window with a width equal to or greater than 2 m/z, such as SWATH™ acquisition, is likely to include isotopic peaks. As described above, on comparison with a library spectrum acquired at unit resolution precursor ion isolation, these isotopic peaks make the two product ion spectra more difficult to compare and can reduce the similarity score.

A number of methods have been proposed for improving the comparison of spectra from such DIA methods with the spectra of existing libraries. One method involves reacquiring the library spectra using the DIA method. Using this method, the library spectra would also include the isotopic peaks. This method, however, is very time consuming, since the spectra for all the known compounds of interest would have to be reacquired using the DIA method.

Another method was proposed in U.S. Provisional Application No. 62/006,805, entitled "Method for Converting Mass Spectral Libraries into Accurate Mass Spectral Libraries." In this method, the chemical composition of each compound in an existing spectral library is analyzed, and, from the chemical composition, isotopes are theoretically generated and the product ions of the theoretically generated are added back into the library product ion spectrum of the compound. One drawback of this method, however, is that it is not always possible to unambiguously determine the chemical composition of a library fragment.

As a result, additional systems and methods are needed to compare experimental product ion spectra acquired from DIA methods that use precursor ion mass selection windows with widths equal to or greater than 2 m/z to existing library spectra acquired at unit resolution precursor ion isolation.

SUMMARY

A system is disclosed for acquiring an unknown product ion spectrum and marking isotopic product ion peaks from the unknown product ion spectrum for removal before comparing the unknown product ion spectrum with a library product ion spectrum. The system includes an ion source, a tandem mass spectrometer, and a processor.

The ion source ionizes one or more compounds of a sample, producing an ion beam of precursor ions. The tandem mass spectrometer receives the ion beam from the ion source. The tandem mass spectrometer selects one or more precursor ions from the ion beam using a precursor ion mass selection window, fragments precursor ions within the precursor ion mass selection window, and mass analyzes the resulting product ions, producing an unknown product ion mass spectrum for the precursor ion mass selection window.

The processor receives the unknown product ion mass spectrum from the tandem mass spectrometer. The processor retrieves from a memory a library product ion mass spectrum for a known compound. For each peak of the unknown product ion mass spectrum, the processor determines if a following peak of the each peak is a non-halogen isotopic peak. If the following peak is a non-halogen isotopic peak, the processor determines if the library product ion mass spectrum includes a peak at the same m/z value of the following peak within a threshold tolerance range. If the library product ion mass spectrum does not include a peak at the same m/z value of the following peak within the threshold tolerance range, the processor marks the following peak for removal from unknown product ion mass spectrum.

A method is disclosed for acquiring an unknown product ion spectrum and marking isotopic product ion peaks from the unknown product ion spectrum for removal before comparing the unknown product ion spectrum with a library product ion spectrum.

One or more compounds of a sample are ionized using an ion source, producing an ion beam of precursor ions. The ion beam is received from the ion source, one or more precursor ions are selected from the ion beam using a precursor ion mass selection window, precursor ions within the precursor ion mass selection window are fragmented, and the resulting product ions are mass analyzed using a tandem mass spectrometer, producing an unknown product ion mass spectrum for the precursor ion mass selection window.

The unknown product ion mass spectrum is received from the tandem mass spectrometer using a processor. A library product ion mass spectrum for a known compound is retrieved from a memory using the processor.

Each peak of the unknown product ion mass spectrum is analyzed for a potential non-halogen isotopic peak, and if a potential non-halogen isotopic is found, it is marked for removal if it does not have a corresponding peak in the library spectrum. If the following peak is a non-halogen isotopic peak, it is also determined if the library product ion mass spectrum includes a peak at the same m/z value of the following peak within a threshold tolerance range. If the library product ion mass spectrum does not include a peak at the same m/z value of the following peak within the threshold tolerance range, the following peak is marked for removal from unknown product ion mass spectrum.

A computer program product is disclosed that includes a non-transitory and tangible computer-readable storage medium whose contents include a program with instructions being executed on a processor so as to perform a method for acquiring an unknown product ion spectrum and marking isotopic product ion peaks from the unknown product ion spectrum for removal before comparing the unknown product ion spectrum with a library product ion spectrum. In various embodiments, the method includes providing a system, wherein the system comprises one or more distinct software modules, and wherein the distinct software modules comprise a measurement module and an analysis module.

The measurement module receives an unknown product ion mass spectrum from a tandem mass spectrometer. One or more known compounds of a sample are ionized using an ion source, producing an ion beam of precursor ions. The tandem mass spectrometer receives the ion beam from the ion source, selects one or more precursor ions from the ion beam using a precursor ion mass selection window, fragments precursor ions within the precursor ion mass selection window, and mass analyzes the resulting product ions, producing the unknown product ion mass spectrum for the precursor ion mass selection window.

The analysis module receives the unknown product ion mass spectrum from the tandem mass spectrometer. The analysis module retrieves from a memory a library product ion mass spectrum for a known compound. The analysis module determines, for each peak of the unknown product ion mass spectrum, if a following peak of the peak is a non-halogen isotopic peak. If the following peak is a non-halogen isotopic peak, the analysis module determines if the library product ion mass spectrum includes a peak at the same m/z value of the following peak within a threshold tolerance range. If the library product ion mass spectrum does not include a peak at the same m/z value of the following peak within the threshold tolerance range, the analysis module marks the following peak for removal from unknown product ion mass spectrum.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
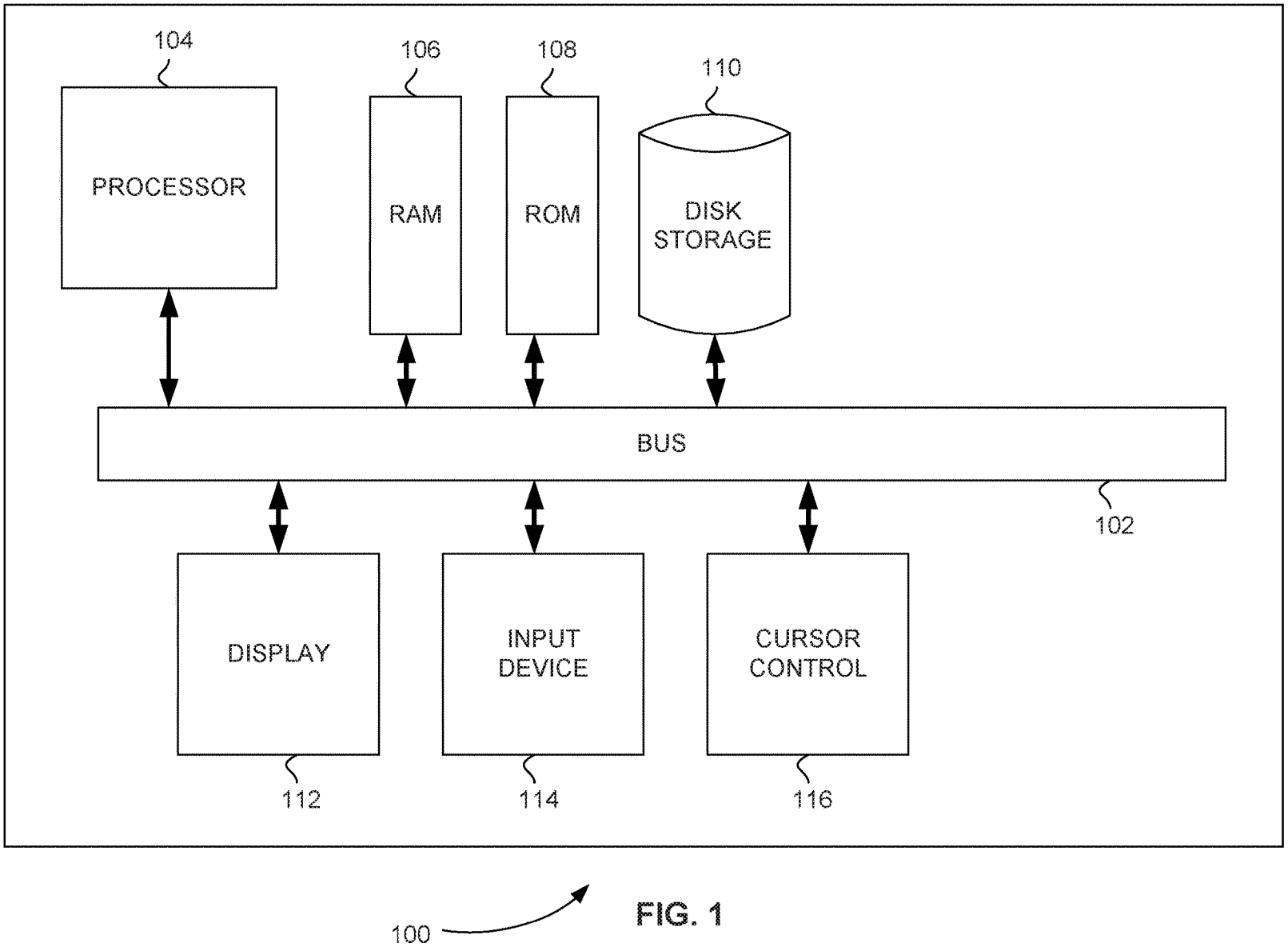
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Isotopic Peak Removal for Library Search

As described above, library searching is used to identify an unknown compound or to confirm the presence of a suspected compound. This is done by comparing the product ion mass spectrum, of a pure standard (the "library" spectrum) with an experimental product ion mass spectrum (the "unknown" spectrum).

Existing product ion spectral libraries typically contain data acquired at unit resolution precursor ion isolation, so isotopic peaks are not present in library product ion spectra. If, however, the unknown mass spectrum is acquired with a precursor ion mass isolation window wide enough to include isotopic peaks, the two spectra are more difficult to compare and the similarity score can be reduced by the isotopic peaks.

Library spectra generally do not include isotope peaks because they were acquired using a tandem mass spectrometry method in which a narrow precursor mass isolation window was used. Generally, targeted acquisition, information dependent acquisition (IDA), and even some data independent acquisition (DIA) tandem mass spectrometry methods use a narrow precursor mass isolation window. However, DIA methods, such as SWATH™ acquisition, use precursor mass isolation window wide enough to include isotopic peaks.

In general, any tandem mass spectrometry method that uses a precursor ion mass selection window with a width equal to or greater than 2 m/z, such as SWATH™ acquisition, is likely to include isotopic peaks. As described above, on comparison with a library spectrum acquired at unit resolution precursor ion isolation, these isotopic peaks make the two product ion spectra more difficult to compare and can incorrectly reduce the similarity score.

Methods such as reacquiring the library spectra using wider precursor ion mass selection windows and updating the library spectra with isotopic peaks theoretically generated from the chemical compositions of the known compounds have been proposed. However, each of these methods has drawbacks. Also, each of these methods involves modifying the library spectra.

In various embodiments, systems and methods are provided that modify the unknown spectra before comparing them with library spectra that were acquired at unit resolution precursor ion isolation. More specifically, isotopic peaks are judiciously removed from unknown spectra before comparing them to library spectra.

Figure 2:
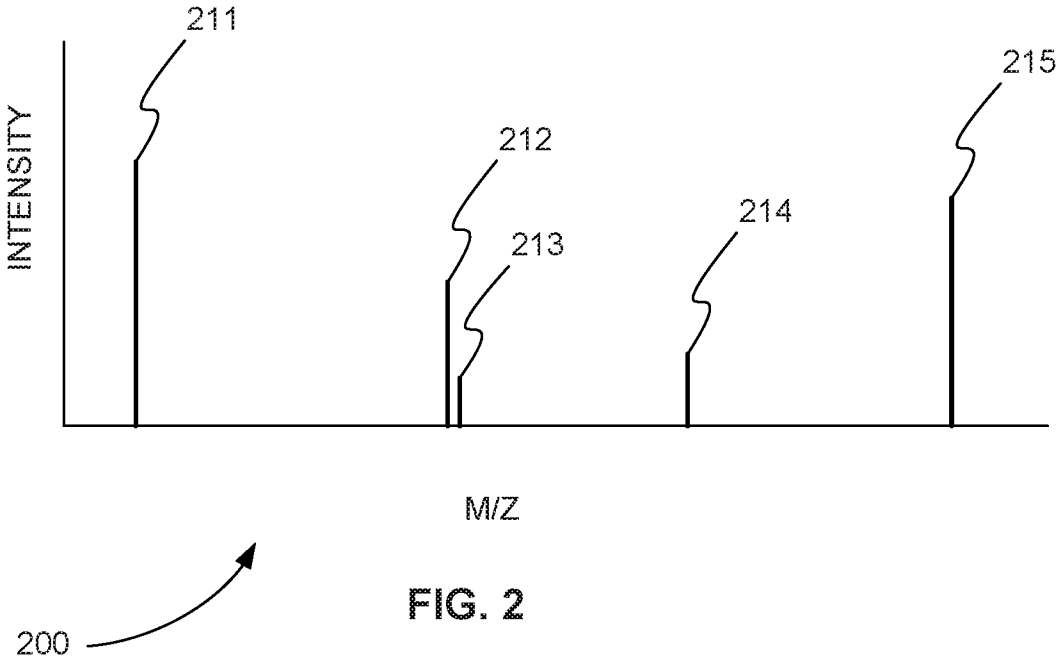
FIG. 2 is an exemplary plot of a library product ion spectrum of a known compound acquired at unit resolution precursor ion isolation, in accordance with various embodiments.

FIG. 2 is an exemplary plot 200 of a library product ion spectrum of a known compound acquired at unit resolution precursor ion isolation, in accordance with various embodiments. The library spectrum of FIG. 2 includes five intensity peaks 211-215, representing five product ions.

The five intensity peaks 211-215 do not include any isotopic peaks, because the spectrum was acquired with a precursor ion mass isolation window of 1 m/z or less. Peak 213, for example, looks like an isotopic peak of peak 212, because it is just 1 m/z away from peak 212. However, peak 213 is not an isotopic peak, because it is known that the library spectrum was acquired with a precursor ion mass isolation window of 1 m/z or less.

The peaks of library spectra are, for example, stored as intensity and m/z values in a file or database. Also stored in the file or database are the name of the known compound, a formula for the chemical composition of the known compound, and other metadata about the known compound, such as identifier numbers. Note that product ion peaks, like peaks 211-215 of FIG. 2, are typically stored in library files or databases as centroid peaks. In other words, each peak is a single m/z value and a single intensity. Therefore, the peaks found in library files or databases have been processed from the raw data, typically using a peak finding algorithm.

Figure 3:
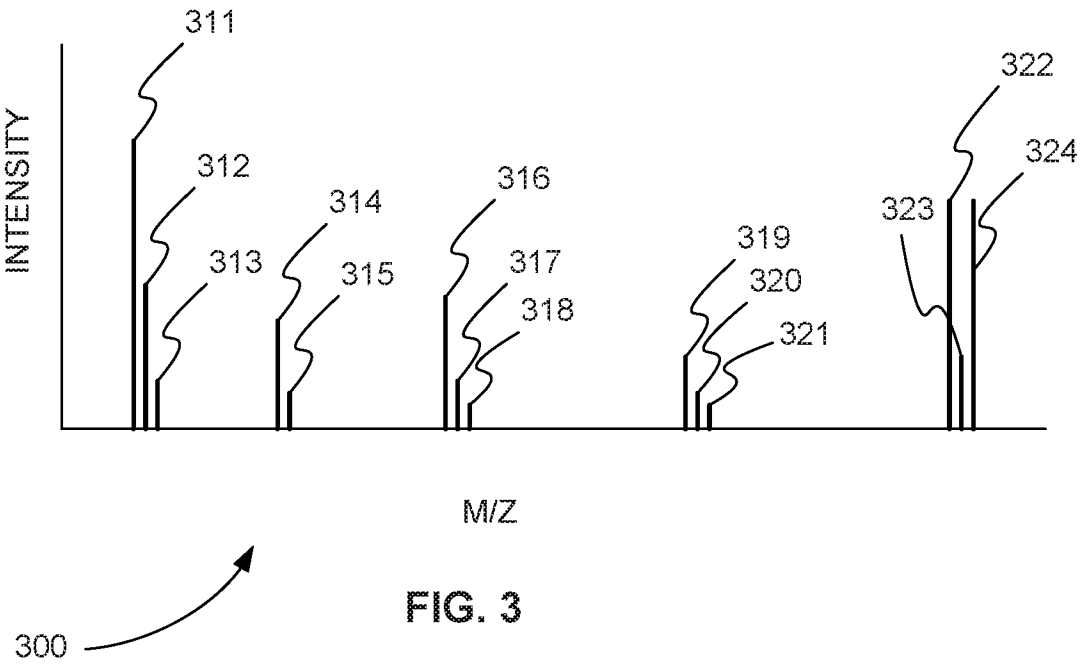
FIG. 3 is an exemplary plot of an unknown product ion spectrum acquired using a precursor ion mass selection window with a width equal to or greater than 2 m/z, in accordance with various embodiments.

FIG. 3 is an exemplary plot 300 of an unknown product ion spectrum acquired using a precursor ion mass selection window with a width equal to or greater than 2 m/z, in accordance with various embodiments. The unknown spectrum of FIG. 3 includes 14 intensity peaks 311-224, representing 14 product ions. The 14 intensity peaks of FIG. 3 can include isotopic peaks, because the precursor ion mass selection window used is wide enough to allow contributions from isotopes of precursor ions.

In order to determine the identity of the compound or compounds represented by the unknown spectrum of FIG. 3, the unknown spectrum is compared to library spectra. For example, the unknown spectrum of FIG. 3 is compared to the library spectrum of FIG. 2. Note that the product ion peaks of FIG. 3 are also centroid peaks produced from some initial processing of the raw data, such a peak finding. In other words, each peak is a single m/z value and a single intensity.

Conventionally, the peaks of the unknown spectrum of FIG. 3 and the peaks of the library spectrum of FIG. 2 are aligned. A similarity score is then calculated based on how well all of the peaks of the unknown spectrum of FIG. 3 match the peaks of the library spectrum of FIG. 2.

As described above, product ion peaks not shared by the two spectra reduce the similarity score. Because the unknown spectrum of FIG. 3 has 14 product ion peaks and the library spectrum of FIG. 2 has 5 product ion peaks, a conventional comparison of these two spectra produces 9 product ion peaks not shared by the two spectra. This large number of product ion peaks that are not shared is likely to significantly reduce the similarity score and suggest that the known compound represented by the library spectrum of FIG. 2 is not compound in the unknown spectrum of FIG. 3.

In various embodiments, the comparison of unknown and library spectra is improved by preprocessing the unknown spectra for isotopic peaks before the comparison with the library spectra. For example, the unknown spectrum of FIG. 3 can be preprocessed to remove isotopic peaks before it is compared to the library spectrum of FIG. 2.

In various embodiments, preprocessing unknown spectra can involve locating non-halogen isotopic peaks using a non-halogen isotopic peak finding algorithm. In general, non-halogen isotopic peaks are product ion peaks that vary by 1 m/z from a preceding peak. They can be produced by isotopic forms of carbon, for example. In contrast, halogen isotopic peaks are product ion peaks that vary by a multiple of 2 m/z from a preceding peak. They are produced by halogen atoms.

Non-halogen isotopic peaks also generally have an intensity that is less than the non-isotopic peak. For example, suppose there is a following peak that is 1 m/z higher than a current peak. However, the intensity of the following peak is much larger than the current peak. Then it is very unlikely that the following peak is really an isotope, so it is not removed. In various embodiments, a calculation of the expected isotope intensity (relative to the starting peak) is made, and, if the possible isotope is within a (large) tolerance factor of that expected ratio, then it is assumed to be an isotope and removed. Also, the relative intensity of isotopes gets larger at higher m/z. The non-halogen isotopic peak finding algorithm, therefore, also takes the intensity of a following peak into account in determining if it is an isotopic peak.

Each peak that is determined to be a non-halogen isotopic peak is marked for removal. Once all peaks have been analyzed, the peaks marked for removal are then removed from the unknown spectra. All the non-halogen isotopic peaks are removed from the unknown spectra before they are compared with library spectra. For example, in FIG. 3 the m/z value of peak 312 is 1 m/z greater than the m/z value peak 311, and the intensity of peak 312 is less than the intensity of peak 311. Peak 312, therefore, is suspected of being a non-halogen isotopic peak and is eventually removed from the unknown spectrum of FIG. 3. Similarly, peak 313 is 1 m/z greater than the m/z value peak 312, and the intensity of peak 313 is less than the intensity of peak 312. Peak 313, therefore, is also suspected of being a non-halogen isotopic peak and is eventually removed from the unknown spectrum of FIG. 3.

This blind removal of non-halogen isotopic peaks has a problem, however. In some cases, a compound may have product ion peaks that are 1 m/z apart. For example, the library spectrum of FIG. 2 includes peaks 212 and 213. Peaks 212 and 213 are 1 m/z apart. In FIG. 3, unknown peaks 316 and 317 correspond to peaks 212 and 213 of the library spectrum in FIG. 2. If peak 317 is removed from the unknown spectrum of FIG. 3 because it is 1 m/z greater than peak 316, it will not be available for comparison with peak 213 in FIG. 2. As a result, the comparison with the library spectrum of FIG. 2 will get a lower similarity score than it should.

In various embodiments, the removal of isotopic peaks from unknown spectra is improved by first comparing potential isotopic peaks in the unknown spectra with corresponding regions in each library spectra. If a library spectrum is found to have a peak that corresponds to a potential isotopic peak in an unknown spectrum, the potential isotopic peak is not removed from the unknown spectrum for the comparison with that library spectrum. In this way, false positive isotopic peaks can be found.

For example, when peak 317 of the unknown spectrum of FIG. 3 is identified as a potential isotopic peak of peak 316, the library spectrum of FIG. 2 is examined for a peak at the same m/z (within an error tolerance) as peak 317. Since peak 213 in the library spectrum of FIG. 2 is found at the same m/z, peak 317 of FIG. 3 is not removed for the comparison and scoring of the unknown spectrum of FIG. 3 with the library spectrum of FIG. 2. Note that because the removal of a potential isotopic peak is dependent on a particular library spectrum, the unknown spectrum is processed differently for each different library spectrum.

Figure 4:
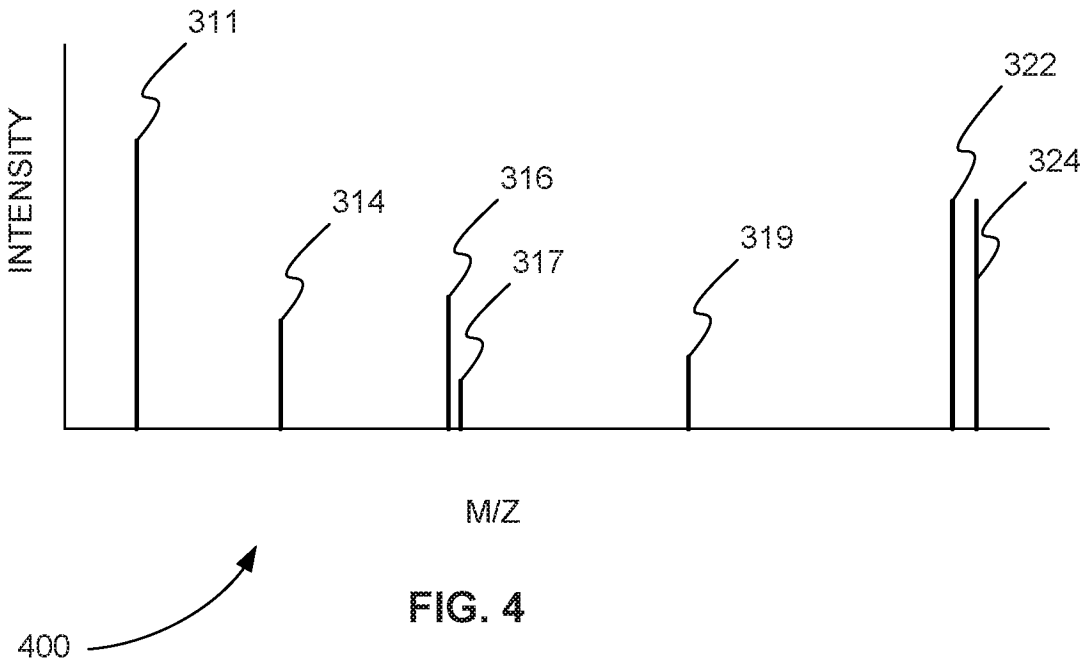
FIG. 4 is an exemplary plot of the unknown product ion spectrum of FIG. 3 after potential non-halogen isotopic peaks are removed that have no corresponding peaks in the library spectrum of FIG. 2, in accordance with various embodiments.

FIG. 4 is an exemplary plot 400 of the unknown product ion spectrum of FIG. 3 after potential non-halogen isotopic peaks are removed that have no corresponding peaks in the library spectrum of FIG. 2, in accordance with various embodiments. Note that potential non-halogen isotopic peaks 317 and 324 remain in the spectrum of FIG. 4. Peak 317 remains, because it corresponds to peak 213 of the library spectrum in FIG. 2. Peak 324 remains, because its intensity is greater than the intensity of peak 323 of FIG. 3. In other words, peak 324 was found not to be a non-halogen isotopic peak.

Unknown spectra can also include halogen isotopic peaks. As described above, halogen isotopic peaks are product ion peaks that vary by a multiple of 2 m/z from a preceding peak. For example, compounds that include halogen atoms can have isotopes that have peaks 2 or 4 m/z from their non-isotopic peaks. For example, peak 324 of FIG. 4 is located 2 m/z from peak 322.

For the majority of compounds which do not have a halogen atom, peaks 2 m/z or higher than their non-isotopic peak are unrelated. As a result, removing them as potential halogen isotopes would be incorrect. So it is best to do this only if it is known for sure that the compound of interest is halogenated.

In various embodiments, before potential halogen isotopic peaks are identified for possible removal in an unknown spectrum, the chemical composition of the known compound of the library spectrum is examined for components or atoms likely to result in halogen isotopic peaks. As described above, library files or databases typically also include the formula of the known compound, which provides the chemical composition of the known compound.

This analysis of the chemical composition can also be done before identifying potential non-halogen isotopic peaks. However, carbon is known to produce isotopic peaks that are 1 m/z higher than the non-isotopic peaks, and carbon is part of most compounds analyzed in mass spectrometry. As a result, doing a chemical composition analysis before removing potential non-halogen isotopic peaks is unnecessary in most mass spectrometry experiments.

Consequently, in various embodiments, before potential halogen isotopic peaks are identified, the chemical composition of the known compound of the library spectrum is examined for components or atoms likely to result in those isotopic peaks. If a halogen atom is found in the chemical composition of the known compound of the library spectrum, a halogen isotopic peak finding algorithm is used to identify halogen isotopic peaks in the unknown spectrum before it is compared to the library spectrum.

Figure 5:
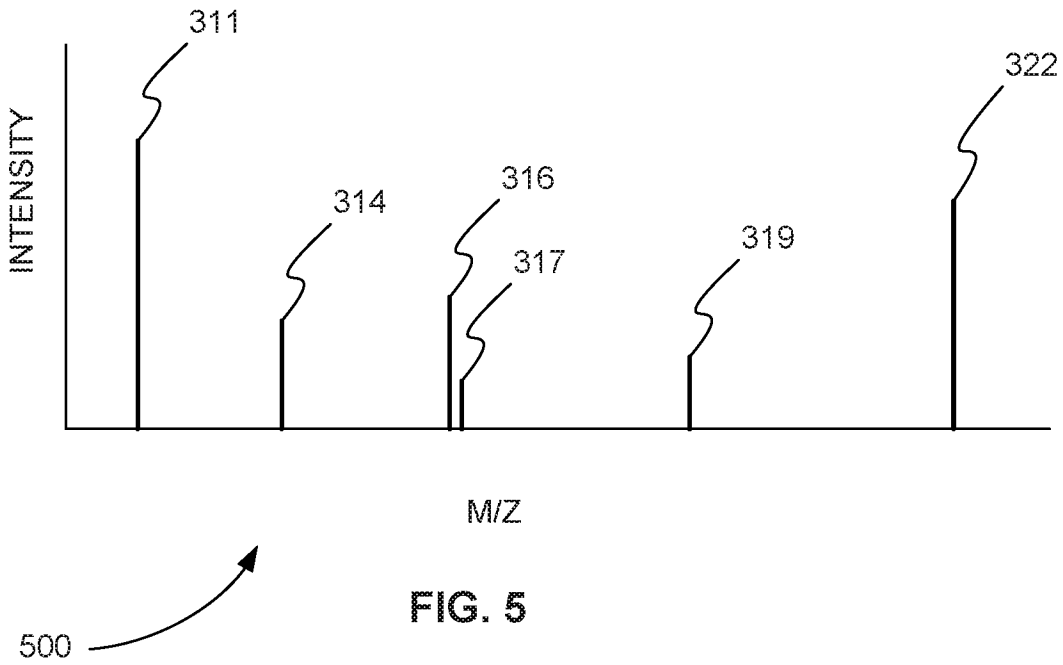
FIG. 5 is an exemplary plot of the unknown product ion spectrum of FIG. 4 after the known compound of library spectrum of FIG. 2 is found to include a halogen component and potential halogen isotopic peaks are removed that have no corresponding peaks in the library spectrum of FIG. 2, in accordance with various embodiments.

FIG. 5 is an exemplary plot 500 of the unknown product ion spectrum of FIG. 4 after the known compound of library spectrum of FIG. 2 is found to include a halogen component and potential halogen isotopic peaks are removed that have no corresponding peaks in the library spectrum of FIG. 2, in accordance with various embodiments. Peak 324 of FIG. 4 was found to be a halogen isotopic peak and was removed, for example.

A comparison of FIGS. 3 and 5 with FIG. 2 shows that the unknown product ion spectrum of FIG. 5 is now much more similar to the library product ion spectrum of FIG. 2 than the unknown product ion spectrum of FIG. 3. As a result, the processed unknown spectrum of FIG. 5 is now likely to produce a better similarity score with the library spectrum of FIG. 2 than the unknown spectrum of FIG. 3.

Also note that the unknown spectrum of FIG. 5 includes peak 314, which does not have a corresponding peak in the library product ion spectrum of FIG. 2. This peak is likely a product ion peak of another compound.

In various embodiments, an unknown product ion spectrum is further processed to remove product ion peaks of other compounds before comparing the unknown spectrum to a library product ion spectrum. For example, if a separation device has been used, timing information is available for each product ion peak of the unknown product ion spectrum. This timing information includes a centroid retention time and a peak shape that is a function of time. Product ions from the same compound have essentially the same retention time and peak shape.

As a result, an extracted ion chromatogram (XIC) is calculated for each product ion represented by each peak in the unknown product ion spectrum. A chromatogram is a representation of mass spectrometry data as a chromatogram, where the x-axis represents time and the y-axis represents signal intensity. https://en.wikipedia.org/wiki/Mass_chromatogram as of Jul. 24, 2015. An XIC includes one or more m/z values representing one or more analytes of interest that are recovered ('extracted') from the entire data set for a chromatographic run. Id.

The retention times and peak shapes of the XICs are compared and XICs with similar retention times and peak shapes (within retention time and shape tolerance thresholds) are placed into groups. Each group then represents a different compound. If there are two or more groups of XICs, the unknown product ion spectrum is divided into two or more unknown product ion spectra. Each spectrum of the two or more unknown product ion spectra includes product ion peaks from the same XIC group, or the product ion peaks of just one compound. Each unknown product ion spectrum representing just one compound is then compared to each library product ion spectrum.

Figure 6:
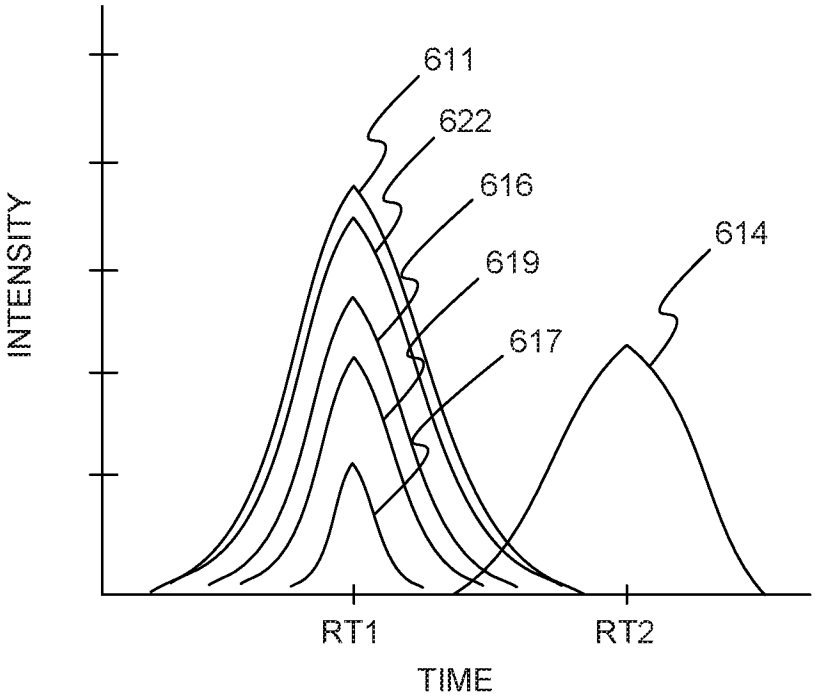
FIG. 6 is an exemplary plot of the extracted ion chromatograms (XICs) calculated for the six product ion peaks of the unknown product ion spectrum of FIG. 5, in accordance with various embodiments.

FIG. 6 is an exemplary plot 600 of the XICs calculated for the six product ion peaks of the unknown product ion spectrum of FIG. 5, in accordance with various embodiments. XIC peaks 611, 614, 616, 617, 619, and 622 of FIG. 6 corresponds to product ion peaks 311, 314, 316, 317, 319, and 322 of FIG. 5, respectively. FIG. 6 shows that of the six XIC peaks, only XIC peak 614 has a different retention time, RT2, and peak shape. As a result, XIC peaks 611, 616, 617, 619, and 622 are in one group and XIC peak 614 is in another group.

This grouping of XIC peaks can be used to further process the unknown product ion spectrum of FIG. 5. For example, since only peak 314 has an XIC peak that is not in the same XIC group as the XICs of the other peaks in FIG. 5, peak 314 can be removed from the unknown product ion spectrum of FIG. 5 and placed in a separate unknown spectrum. These two unknown product ion spectra are then compared separately to each of the library spectra.

Figure 7:
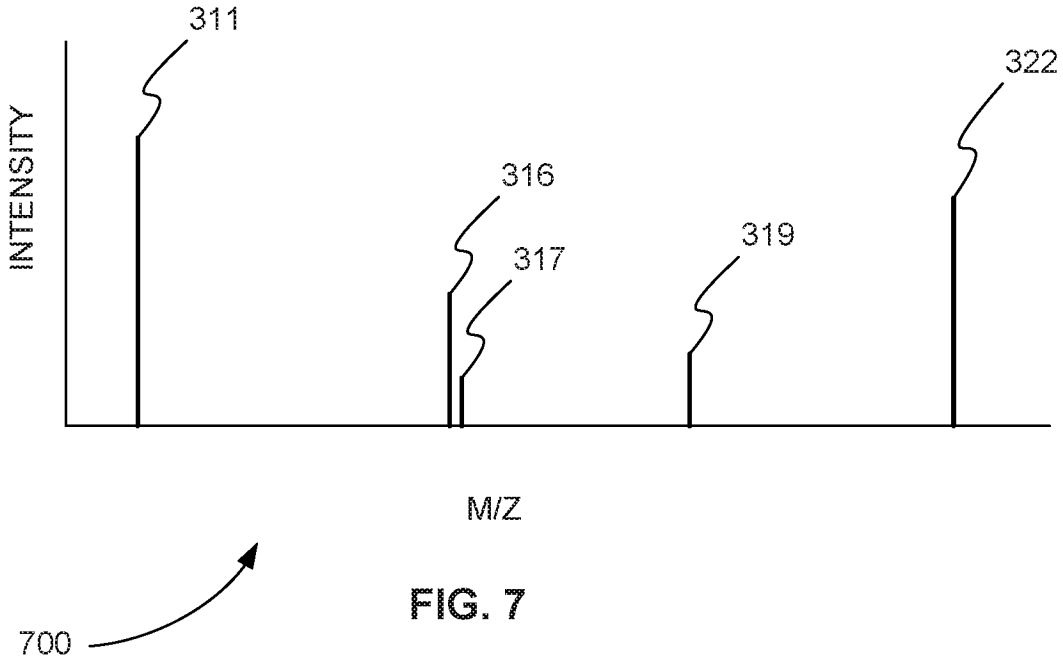
FIG. 7 is an exemplary plot of an unknown product ion spectrum derived from the unknown product ion spectrum of FIG. 5 after grouping the product ion peaks of FIG. 5 based on the retention times and peak shape of corresponding XIC peaks, in accordance with various embodiments.

FIG. 7 is an exemplary plot 700 of an unknown product ion spectrum derived from the unknown product ion spectrum of FIG. 5 after grouping the product ion peaks of FIG. 5 based on the retention times and peak shape of corresponding XIC peaks, in accordance with various embodiments. Note that in comparison to FIG. 5, peak 314 of the unknown product ion spectrum of FIG. 5 is removed from the unknown product ion spectrum of FIG. 7. Peak 314 of the unknown product ion spectrum of FIG. 5 is included in a separate unknown product ion spectrum (not shown) that is separately compared to each of the library spectra. A comparison of the unknown product ion spectrum of FIG. 7 and the library product ion spectrum of FIG. 2 now shows that all of the peaks of the unknown product ion spectrum have corresponding peaks in the library product ions spectrum. In other words, all of the isotopic peaks and peaks from other compounds (precursor ions) have been removed from the unknown product ion spectrum.

System for Removing Isotopic Peaks from the Unknown Spectrum

Figure 8:
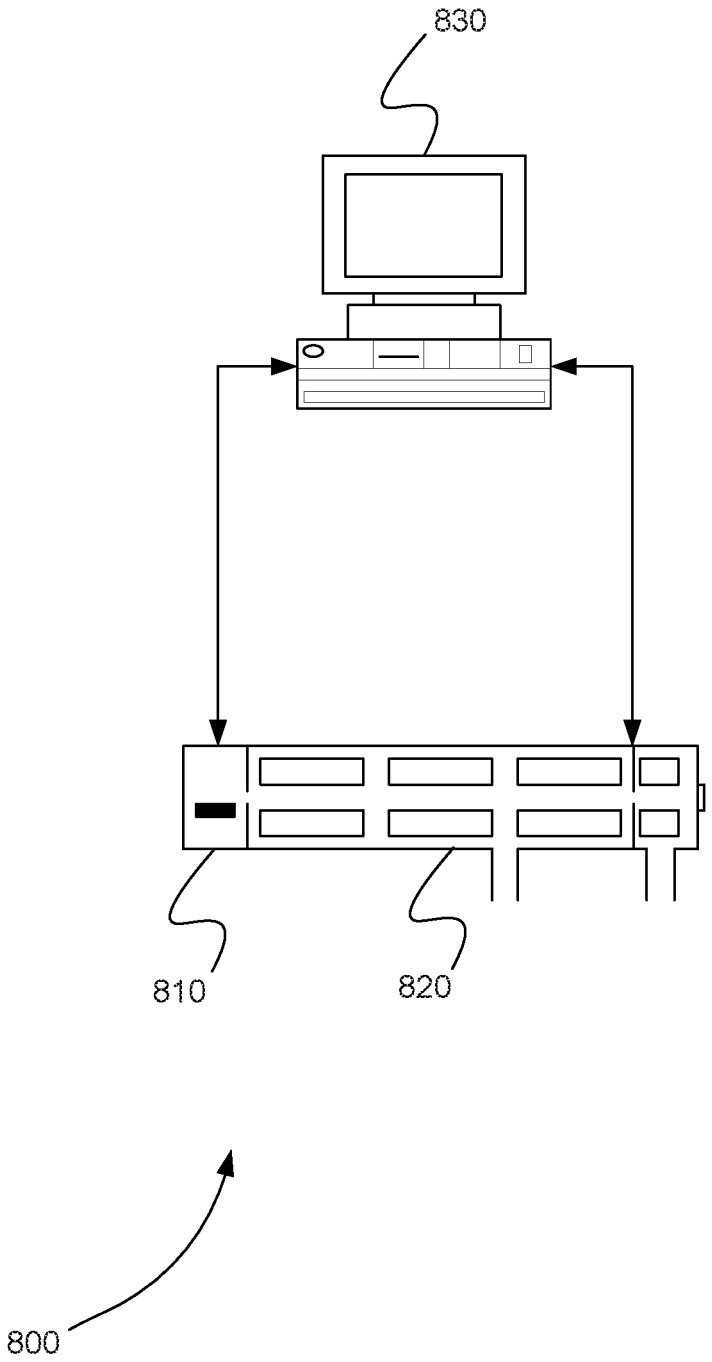
FIG. 8 is a schematic diagram of a system for acquiring an unknown product ion spectrum and marking isotopic product ion peaks from the unknown product ion spectrum for removal before comparing the unknown product ion spectrum with a library product ion spectrum, in accordance with various embodiments.

FIG. 8 is a schematic diagram of system 800 for acquiring an unknown product ion spectrum and marking isotopic product ion peaks from the unknown product ion spectrum for removal before comparing the unknown product ion spectrum with a library product ion spectrum, in accordance with various embodiments. System 800 includes ion source 810, tandem mass spectrometer 820, and processor 830. Ion source 810 ionizes one or more compounds of a sample, producing an ion beam of precursor ions. Ion source 810 can be part of tandem mass spectrometer 820, or can be a separate device.

Tandem mass spectrometer 820 can include, for example, one or more physical mass filters and one or more physical mass analyzers. A mass analyzer of tandem mass spectrometer 820 can include, but is not limited to, a time-of-flight (TOF), quadrupole, an ion trap, a linear ion trap, an orbitrap, or a Fourier transform mass analyzer.

Tandem mass spectrometer 820 receives the ion beam from ion source 810. Tandem mass spectrometer 820 selects one or more precursor ions from the ion beam using a precursor ion mass selection window, fragments precursor ions within the precursor ion mass selection window, and mass analyzes the resulting product ions, producing an unknown product ion mass spectrum for the precursor ion mass selection window.

Processor 830 can be, but is not limited to, a computer, microprocessor, or any device capable of sending and receiving control signals and data from tandem mass spectrometer 820 and processing data. Processor 830 can be, for example, computer system 100 of FIG. 1. In various embodiments, processor 830 is in communication with tandem mass spectrometer 820.

Processor 830 receives the unknown product ion mass spectrum from tandem mass spectrometer 820. Processor 830 retrieves from a memory a library product ion mass spectrum for a known compound. The memory can be an electronic or magnetic memory. In various embodiments the memory can be part of a database.

For each peak of the unknown product ion mass spectrum, processor 830 determines if a following peak of the peak is a non-halogen isotopic peak. For example, processor 830 uses a non-halogen isotopic peak finding algorithm as described above.

If the following peak is a non-halogen isotopic peak, processor 830 determines if the library product ion mass spectrum includes a peak at the same m/z value of the following peak within a threshold tolerance range. If the library product ion mass spectrum does not include a peak at the same m/z value of the following peak within the threshold tolerance range, processor 830 marks the following peak for removal from unknown product ion mass spectrum. If the library product ion mass spectrum does include a peak at the same m/z value of the following peak within the threshold tolerance range, processor 830 does not mark the following peak for removal from unknown product ion mass spectrum. Once all peaks have been processed, processor 830 removes the marked peaks from the unknown spectrum.

In various embodiments, processor 830 further compares the unknown product ion mass spectrum with the library product ion mass spectrum and calculates a similarity score for the comparison. The similarity score is used to identify the compound or confirm its presence.

In various embodiments, the unknown product ion mass spectrum and the library product ion mass spectrum are pre-processed to include centroid m/z values. The unknown product ion mass spectrum is pre-processed by processor 830, for example.

In various embodiments, isotopic product ion peaks are removed when wide precursor ion mass selection windows are used. For example, a wide precursor ion mass selection window has a width that is greater than or equal to 2 m/z.

In various embodiments, processor 830 determines if a wide precursor ion mass selection window is being used. For example, processor 830 further determines if the precursor ion mass selection window has a width that is greater than or equal to 2 m/z. Only if the precursor ion mass selection window has a width that is greater than or equal to 2 m/z does processor 830 determine if the library product ion mass spectrum includes a peak at the same m/z value of the following peak within a threshold tolerance range.

In various embodiments, if a narrow precursor ion mass selection window is being used, isotopic peaks are simply removed from the unknown product ion spectrum. For example, if processor 830 determines that the precursor ion mass selection window does not have a width that is greater than or equal to 2 m/z and the following peak is a non-halogen isotopic peak, processor 830 marks the following peak for removal from unknown product ion mass spectrum.

In various embodiments, the search for isotopic peaks can be contingent on the chemical composition of the known compound. For example, processor 830 further, after retrieving from the memory the library product ion mass spectrum for the known compound, retrieves a formula for the known compound from the memory. Processor 830 determines if the formula includes a halogen atom, for example.

Halogen atoms can cause isotopic peaks that are a multiple of 2 m/z from the non-isotopic peak. In various embodiments, therefore, if the formula includes a halogen atom, processor 830 further determines, for the peak, if a following peak is a halogen isotopic peak. If the following peak is a halogen isotopic peak, processor 830 determines if the library product ion mass spectrum includes a peak at the same m/z value of the following peak within a threshold tolerance range. If the library product ion mass spectrum does not include a peak at the same m/z value of the following peak within the threshold tolerance range, processor 830 marks the following peak for removal from unknown product ion mass spectrum.

In various embodiments, if a separation device is used, peaks related to different compound can be removed from the unknown spectrum before removing isotopic peaks. For example, system 800 can also include a separation device (not shown). A separation device can separate one or more known compounds from a sample over time using a variety of techniques, for example. These techniques include, but are not limited to, ion mobility, gas chromatography (GC), liquid chromatography (LC), or capillary electrophoresis (CE). The separation device is located before ion source 810 and separates the one or more compounds over time before presenting the one or more compounds to ion source 810.

Processor 830 further, before determining for each peak of the unknown product ion spectrum if a following peak of each peak is a non-halogen isotopic peak, performs a number of steps. Processor 830 receives from tandem mass spectrometer 820 a plurality of product ion spectra produced over time, including the unknown product ion spectrum.

Processor 830 calculates an XIC for each peak in the unknown product ion spectrum from the plurality of product ion spectra. Processor 830 groups peaks of the unknown product ion spectrum into groups that have an XIC centroid retention time within a retention time threshold range and an XIC peak shape within a peak shape threshold range. Finally, processor 830 keeps peaks of one group in the unknown product ion spectrum and removes from the unknown product ion spectrum all peaks from other groups.

Method for Removing Isotopic Peaks from the Unknown Spectrum

Figure 9:
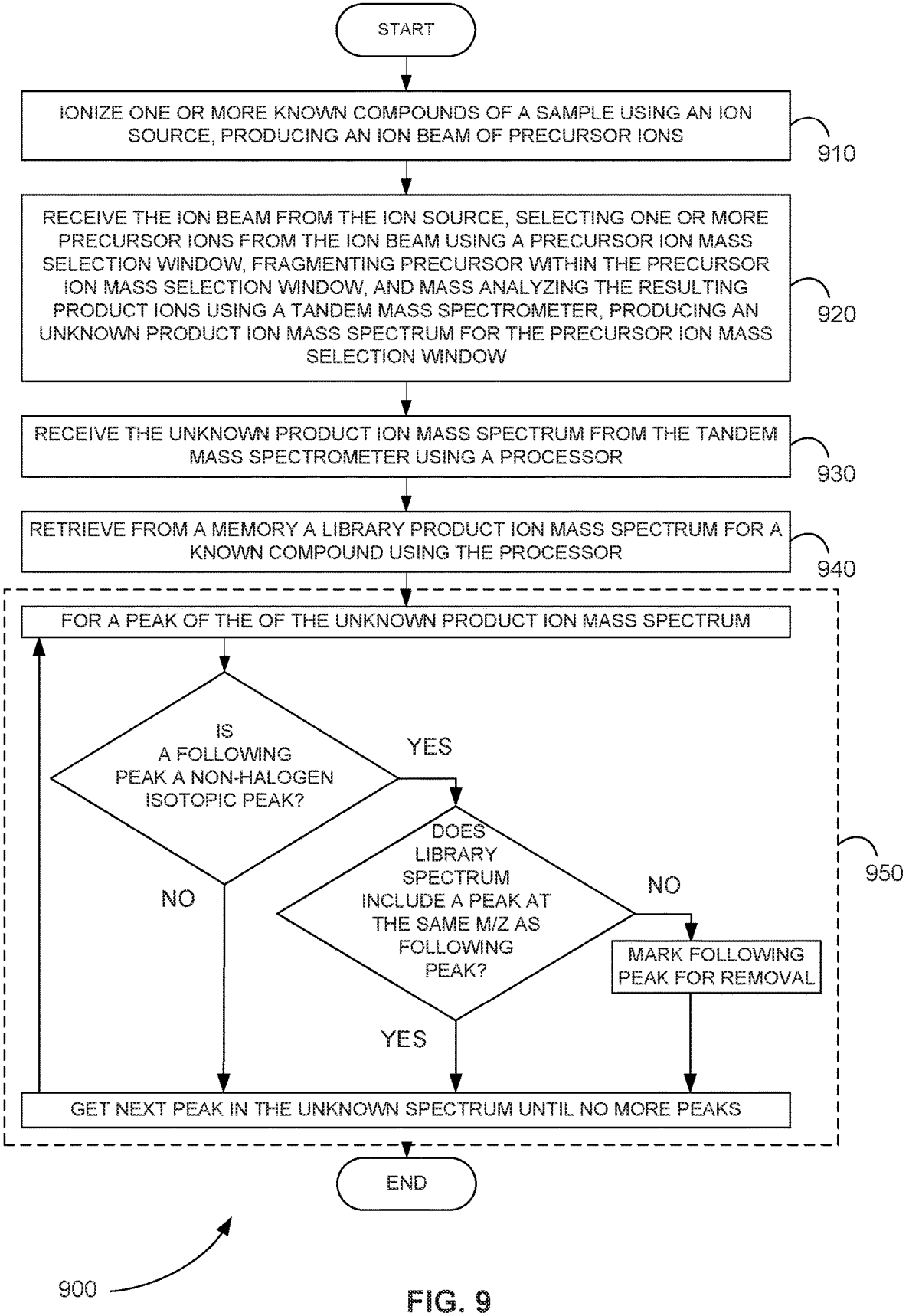
FIG. 9 is a flowchart showing a method for acquiring an unknown product ion spectrum and marking isotopic product ion peaks from the unknown product ion spectrum for removal before comparing the unknown product ion spectrum with a library product ion spectrum, in accordance with various embodiments.

FIG. 9 is a flowchart showing a method 900 for acquiring an unknown product ion spectrum and marking isotopic product ion peaks from the unknown product ion spectrum for removal before comparing the unknown product ion spectrum with a library product ion spectrum, in accordance with various embodiments.

In step 910 of method 900, one or more compounds of a sample are ionized using an ion source, producing an ion beam of precursor ions.

In step 920, the ion beam is received from the ion source, one or more precursor ions are selected from the ion beam using a precursor ion mass selection window, precursor ions within the precursor ion mass selection window are fragmented, and the resulting product ions are mass analyzed using a tandem mass spectrometer, producing an unknown product ion mass spectrum for the precursor ion mass selection window.

In step 930, the unknown product ion mass spectrum is received from the tandem mass spectrometer using a processor.

In step 940, a library product ion mass spectrum for a known compound is retrieved from a memory using the processor.

In step 950, each peak of the unknown product ion mass spectrum is analyzed for a potential non-halogen isotopic peak, and if a potential non-halogen isotopic is found, it is marked for removal if it does not have a corresponding peak in the library spectrum. For example, for each peak of the unknown product ion mass spectrum, it is determined, using the processor, if a following peak of the peak is a non-halogen isotopic peak. If the following peak is a non-halogen isotopic peak, it is also determined if the library product ion mass spectrum includes a peak at the same m/z value of the following peak within a threshold tolerance range. If the library product ion mass spectrum does not include a peak at the same m/z value of the following peak within the threshold tolerance range, the following peak is marked for removal from unknown product ion mass spectrum.

Computer Program Product for Removing Isotopic Peaks

In various embodiments, computer program products include a tangible computer-readable storage medium whose contents include a program with instructions being executed on a processor so as to perform a method for acquiring an unknown product ion spectrum and marking isotopic product ion peaks from the unknown product ion spectrum for removal before comparing the unknown product ion spectrum with a library product ion spectrum. This method is performed by a system that includes one or more distinct software modules.

Figure 10:
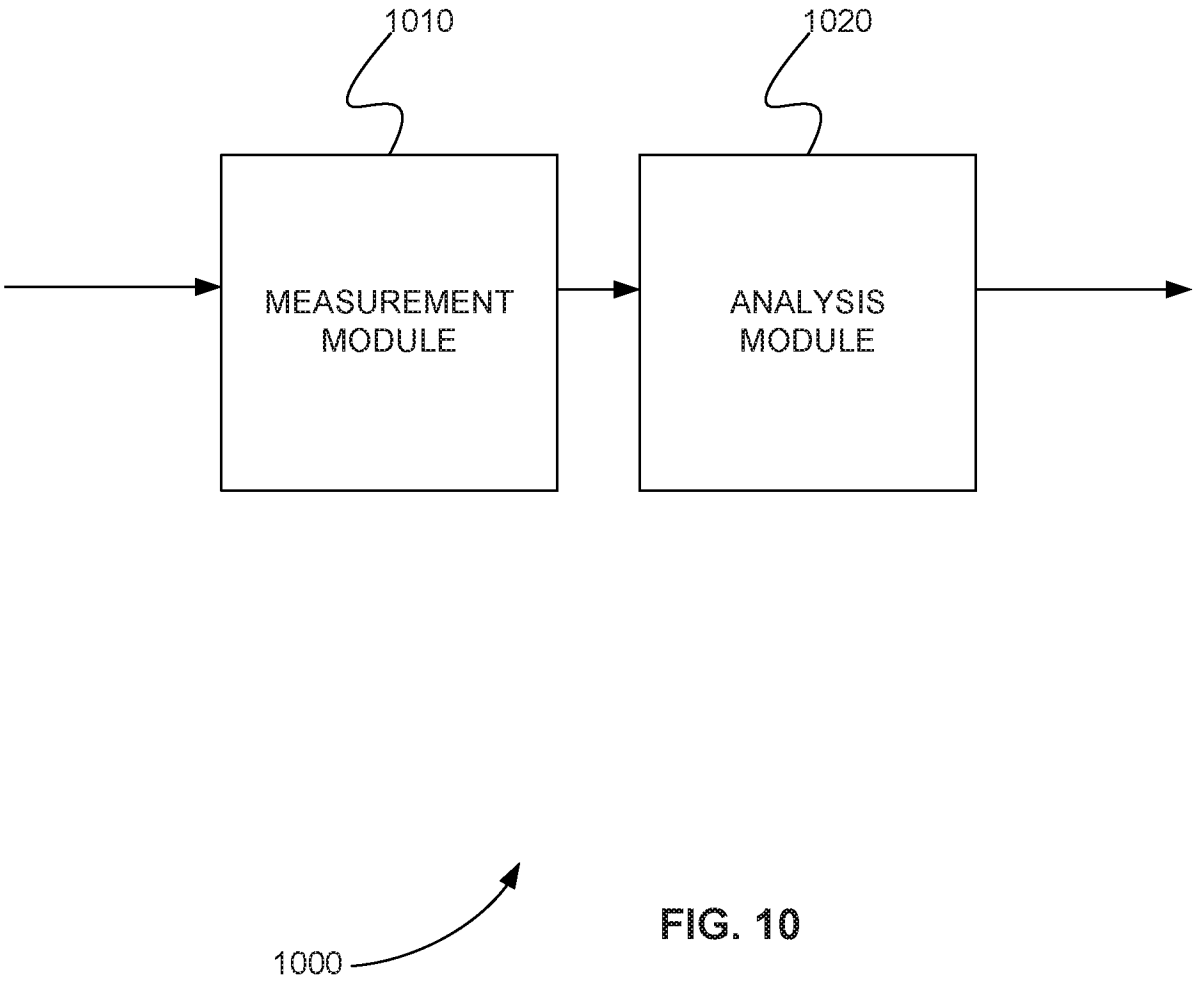
FIG. 10 is a schematic diagram of a system that includes one or more distinct software modules that performs a method for acquiring an unknown product ion spectrum and marking isotopic product ion peaks from the unknown product ion spectrum for removal before comparing the unknown product ion spectrum with a library product ion spectrum, in accordance with various embodiments.

FIG. 10 is a schematic diagram of a system 1000 that includes one or more distinct software modules that performs a method for acquiring an unknown product ion spectrum and marking isotopic product ion peaks from the unknown product ion spectrum for removal before comparing the unknown product ion spectrum with a library product ion spectrum, in accordance with various embodiments. System 1000 includes measurement module 1010 and an analysis module 1020.

Measurement module 1010 receives an unknown product ion mass spectrum from a tandem mass spectrometer. One or more known compounds of a sample are ionized using an ion source, producing an ion beam of precursor ions. The tandem mass spectrometer receives the ion beam from the ion source, selects one or more precursor ions from the ion beam using a precursor ion mass selection window, fragments precursor ions within the precursor ion mass selection window, and mass analyzes the resulting product ions, producing the unknown product ion mass spectrum for the precursor ion mass selection window.

Analysis module 1020 receives the unknown product ion mass spectrum from the tandem mass spectrometer. Analysis module 1020 retrieves from a memory a library product ion mass spectrum for a known compound. Analysis module 1020 determines, for each peak of the unknown product ion mass spectrum, if a following peak of the peak is a non-halogen isotopic peak. If the following peak is a non-halogen isotopic peak, analysis module 1020 determines if the library product ion mass spectrum includes a peak at the same m/z value of the following peak within a threshold tolerance range. If the library product ion mass spectrum does not include a peak at the same m/z value of the following peak within the threshold tolerance range, analysis module 1020 marks the following peak for removal from unknown product ion mass spectrum.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Note that the terms "mass" and "m/z" are used interchangeably herein. Generally, mass spectrometry measurements are made in m/z and converted to mass by multiplying by charge.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for acquiring an unknown product ion spectrum and marking isotopic product ion peaks from the unknown product ion spectrum for removal before comparing the unknown product ion spectrum with a library product ion spectrum, comprising:

an ion source that ionizes one or more compounds of a sample, producing an ion beam of precursor ions;

a tandem mass spectrometer that receives the ion beam from the ion source, selects one or more precursor ions from the ion beam using a precursor ion mass selection window, fragments precursor ions within the precursor ion mass selection window, and mass analyzes the resulting product ions, producing an unknown product ion mass spectrum for the precursor ion mass selection window; and a processor in communication with the tandem mass spectrometer that receives the unknown product ion mass spectrum from the tandem mass spectrometer, retrieves from a memory a library product ion mass spectrum for a known compound, for each peak of the unknown product ion mass spectrum, determines if a following peak of the each peak is a non-halogen isotopic peak and if the following peak is a non-halogen isotopic peak, determines if the library product ion mass spectrum includes a peak at the same m/z value of the following peak within a threshold tolerance range, and if the library product ion mass spectrum does not include a peak at the same m/z value of the following peak within the threshold tolerance range, marks the following peak for removal from unknown product ion mass spectrum.

2. The system of claim 1, wherein if the library product ion mass spectrum does include a peak at the same m/z value of the following peak within the threshold tolerance range, the processor does not mark the following peak for removal from unknown product ion mass spectrum.

3. The system of claim 1, wherein the processor further removes all peaks marked for removal from the unknown product ion mass spectrum before comparing the unknown product ion mass spectrum with the library product ion mass spectrum and calculating a similarity score for the comparison.

4. The system of claim 1, wherein the unknown product ion mass spectrum and the library product ion mass spectrum include centroid m/z values.

5. The system of claim 1, wherein precursor ion mass selection window has a width that is greater than or equal to 2 m/z.

6. The system of claim 1, wherein the processor further determines if the precursor ion mass selection window has a width that is greater than or equal to 2 m/z and only if the precursor ion mass selection window has a width that is greater than or equal to 2 m/z does the processor determine if the library product ion mass spectrum includes a peak at the same m/z value of the following peak within a threshold tolerance range.

7. The system of claim 6, wherein if the processor determines that the precursor ion mass selection window does not have a width that is greater than or equal to 2 m/z and the following peak is a non-halogen isotopic peak, the processor marks the following peak for removal from unknown product ion mass spectrum.

8. The system of claim 1, wherein the processor further after retrieving the library product ion mass spectrum for the known compound from the memory, further retrieves a formula for the known compound from the memory, determines if the formula includes a halogen atom, if the formula includes a halogen atom, determines if a following peak of the each peak is a halogen isotopic peak, and if the following peak is a halogen isotopic peak, determines if the library product ion mass spectrum includes a peak at the same m/z value of the following peak within a threshold tolerance range, and if the library product ion mass spectrum does not include a peak at the same m/z value of the following peak within the threshold tolerance range, marks the following peak for removal from unknown product ion mass spectrum.

9. The system of claim 8, wherein if the library product ion mass spectrum does include a peak at the same m/z value of the following peak, the processor does not mark the following peak for removal from unknown product ion mass spectrum.

10. The system of claim 8, wherein the processor further removes all peaks marked for removal from the unknown product ion mass spectrum before comparing the unknown product ion mass spectrum with the library product ion mass spectrum and calculating a similarity score for the comparison.

11. The system of claim 1, further comprising a separation device located before the ion source that separates the one or more compounds over time before presenting the one or more compounds to the ion source, wherein the processor further, before determining for each peak of the unknown product ion spectrum if a following peak of the each peak is a non-halogen isotopic peak, receives from the tandem mass spectrometer a plurality of product ion spectra produced over time, including the unknown product ion spectrum, calculates an extracted ion chromatogram (XIC) for each peak in the unknown product ion spectrum from the plurality of product ion spectra, groups peaks of the unknown product ion spectrum into groups that have an XIC centroid retention time within a retention time threshold range and an XIC peak shape within a peak shape threshold range, and keeps peaks of one group in the unknown product ion spectrum and removes from the unknown product ion spectrum all peaks from other groups.

12. A method for acquiring an unknown product ion spectrum and marking isotopic product ion peaks from the unknown product ion spectrum for removal before comparing the unknown product ion spectrum with a library product ion spectrum, comprising:

ionizing one or more compounds of a sample using an ion source, producing an ion beam of precursor ions;

receiving the ion beam from the ion source, selecting one or more precursor ions from the ion beam using a precursor ion mass selection window, fragmenting precursor ions within the precursor ion mass selection window, and mass analyzing the resulting product ions using a tandem mass spectrometer, producing an unknown product ion mass spectrum for the precursor ion mass selection window;

receiving the unknown product ion mass spectrum from the tandem mass spectrometer using a processor;

retrieving from a memory a library product ion mass spectrum for a known compound using the processor; and determining, for each peak of the unknown product ion mass spectrum using the processor, if a following peak of the each peak is a non-halogen isotopic peak and, if the following peak is a non-halogen isotopic peak, determining if the library product ion mass spectrum includes a peak at the same m/z value of the following peak within a threshold tolerance range and, if the library product ion mass spectrum does not include a peak at the same m/z value of the following peak within the threshold tolerance range, removing the following peak from unknown product ion mass spectrum.

13. A computer program product, comprising a non-transitory and tangible computer-readable storage medium whose contents include a program with instructions being executed on a processor so as to perform a method for acquiring an unknown product ion spectrum and marking isotopic product ion peaks from the unknown product ion spectrum for removal before comparing the unknown product ion spectrum with a library product ion spectrum, the method comprising:

providing a system, wherein the system comprises one or more distinct software modules, and wherein the distinct software modules comprise a measurement module and an analysis module;

receiving an unknown product ion mass spectrum from a tandem mass spectrometer using the measurement module, wherein one or more known compounds of a sample are ionized using an ion source, producing an ion beam of precursor ions and wherein the tandem mass spectrometer receives the ion beam from the ion source, selects one or more precursor ions from the ion beam using a precursor ion mass selection window, fragments precursor ions within the precursor ion mass selection window, and mass analyzes the resulting product ions, producing the unknown product ion mass spectrum for the precursor ion mass selection window;

receiving the unknown product ion mass spectrum from the tandem mass spectrometer using the analysis module;

retrieving from a memory a library product ion mass spectrum for a known compound using the analysis module; and determining, for each peak of the unknown product ion mass spectrum using the analysis module, if a following peak of the each peak is a non-halogen isotopic peak and, if the following peak is a non-halogen isotopic peak, determining if the library product ion mass spectrum includes a peak at the same m/z value of the following peak within a threshold tolerance range and, if the library product ion mass spectrum does not include a peak at the same m/z value of the following peak within the threshold tolerance range, removing the following peak from unknown product ion mass spectrum.

* * * * *